US005353951A

United States Patent [19]

Kusz et al.

[11] Patent Number: 5,353,951

[45] Date of Patent: Oct. 11, 1994

[54] SERVICEABLE STORAGE AND TRANSPORT CONTAINER

[75] Inventors: John P. Kusz, Park Ridge; Gustavo Cuveas, Aurora, both of Ill.

[73] Assignee: Safety-Kleen Corp., Elgin, Ill.

[21] Appl. No.: 928,497

[22] Filed: Aug. 11, 1992

[51] Int. Cl.[5] ..... B65D 21/02

[52] U.S. Cl. ..... 220/571; 220/23.83; 220/628; 220/636; 220/254; 222/153; 222/543

[58] Field of Search ..... 222/153, 543; 220/571, 220/23.83, DIG. 13, 212, 315, 375, 628, 630, 636, 404, 8, 400, 254

[56] References Cited

U.S. PATENT DOCUMENTS

| | | | |
|---|---|---|---|
| 629,977 | 8/1899 | Barber | 220/23.83 |
| 858,501 | 7/1907 | De Mars | 222/153 |
| 2,185,800 | 1/1940 | Damon | 220/375 |
| 3,469,682 | 9/1969 | Cline | 220/23.83 |
| 4,013,105 | 3/1977 | Uuskallio | 220/571 |
| 4,899,885 | 2/1990 | Van Koert | 220/23.83 |
| 5,052,582 | 10/1991 | Hall | 220/571 |
| 5,088,614 | 2/1992 | Dumeste | 220/254 |
| 5,161,690 | 11/1992 | Foshaug | 220/571 |
| 5,201,435 | 4/1993 | Harding et al. | 220/571 |
| 5,226,558 | 7/1993 | Whitney et al. | 220/571 |

*Primary Examiner*—S. Castellano
*Attorney, Agent, or Firm*—James T. Fitzgibbon

[57] ABSTRACT

A storage and transport container for used anti-freeze solutions. The container includes a primary receptacle and a secondary containment and support vessel. The top of the primary receptacle is generally conical but includes a shoulder wall with an opening therein defined by a collar. The closure system includes a contoured shoulder cover, a cap support and a removable cap for the collar. The secondary containment and support vessel includes an outer sidewall and a support shoulder which engages a counterpart, lower shoulder on the primary container. The secondary vessel has a contoured bottom wall constructed so as to register with forklift tines which engage the bottom wall of the secondary receptacle and also support a portion of the primary receptacle that is in contact with the bottom wall of the secondary vessel.

1 Claim, 2 Drawing Sheets

SERVICEABLE STORAGE AND TRANSPORT CONTAINER

The present invention relates generally to special purpose containers, and more particularly, to serviceable storage and transport containers for used vehicle anti-freeze.

In recent years, there has been a continually increasing awareness in the automotive service community of the potential hazards of vehicle-related waste disposal. It is damaging to the environment to simply dispose of materials which are not readily biodegradable by dumping them into the sewer systems in and around municipalities and elsewhere. Therefore, numerous rules and regulations have been adopted that either forbid or severely limit the manner in which oils and greases, such as used motor oil and the like may be disposed of.

More recently, awareness of the potential for environmental damage from coolant materials has heightened. While materials such as alcohols and glycols are water-miscible, this has tended to obscure their potential for environmental damage. Although the damage potential surrounding careless disposition of these materials per se may not be as great as that of other materials which always contain heavy metals and non-biodegradable constituents, it has nevertheless been found that there is significant potential environmental damage attendant to uncontrolled disposition of vehicle anti-freeze.

In addition to the glycol product itself, there may be dissolved in the anti-freeze certain solutions resulting from corrosion of engine blocks, cylinder heads, radiators and other parts of the cooling system. Moreover, the anti-freeze solutions themselves, especially with various inhibitor systems found therein, may hold out significant potential for environmental damage, particularly if disposition is continued on a large scale.

Accordingly, and particularly in view of the fact that vehicle anti-freeze is used up and disposed of regularly, in a manner generally analogous to that of motor oil, it has been found desirable to provide improved methods and apparatus for controlling the post-use disposition of engine coolants and like products.

Accordingly, various systems have been proposed for this purpose. Inasmuch as the simplest and most straightforward way of avoiding direct contamination of ground water and sewage systems is to avoid draining the liquids in the first place, it is not uncommon now to have exhausted anti-freeze dumped in holding tanks or other containers for eventual disposition. The present invention relates to an improved container for safe, medium-to-long term storage vehicle anti-freeze at or near the site at which it is removed from the vehicle and remote from the site at which it is processed. The container provides ready serviceability, for reasons which will appear.

The present invention is particularly advantageous where filled containers of used vehicle anti-freeze may be handled on a service basis, i.e., where a container, once filled, may be picked up and/or emptied by a service specializing in licensed or authorized waste disposition, and wherein the user of the container may retain the container on site until removed or emptied, preferably on a regular service basis, for authorized treatment and/or disposition.

According to this concept, a very large capacity container must be provided and this in turn indicates the need for remote or outside storage.

Accordingly, the present invention relates to a container which will itself be safe environmentally, which will afford weather protection for remote storage, but which is able to be handled by servicing equipment. Moreover, the container should provide some sort of controlled access for receiving individual allotments of anti-freeze until its full capacity is reached, whereupon a removal may be indicated. A desirable container will also include a containment or like secondary exterior vessel to provide further insurance against leakage.

In view of the heretofore existing lack of specialty containers for this purpose, it is an object of the present invention to provide an improved, serviceable anti-freeze storage and transport container.

Another object of the invention is to provide a storage container which is unlikely to contaminate the environment by leakage even if inadvertently damaged.

Still another object of the invention is to provide a container which is relatively secure from interior damage even if inadvertently struck from the exterior.

Yet another object of the invention is to provide an improved vehicle coolant container which is able to be handled by a fork lift without damage, and wherein the provision of such fork lift compatibility will not adversely affect its storage capacity.

A still further object of the invention is to provide a storage container which includes a primary receptacle and an exterior protective vessel which serves to locate the primary receptacle and to contain any leakage which might result from damage to the primary receptacle.

Another object of the invention is to provide a storage and transport container which includes a primary receptacle and a secondary vessel arranged for telescoping fit and general weather tightness, rendering it suitable for storage outside service buildings such as garages or service stations.

Yet another object of the invention is to provide a closure system wherein access to the container for deposition may be provided through one locking system but wherein the unit also includes a second or auxiliary locking system which renders the container separately accessible for contents removal through another security system.

Another object of the invention is to provide a storage and transport container which is made from low cost, readily formed materials.

Yet another object of the invention is to provide a storage and transport container which can be made by simple, known methods not requiring expensive or precision manufacturing equipment.

A still further object of the invention is to provide a storage and transport container which is accessible to recycling service personnel, as well as to the primary user, and which is suitable for storage exterior to a service building or other site of primary usage.

The foregoing objects and advantages of the invention are achieved in practice by providing a storage and transport container for used vehicle anti-freeze or the like, with the container including a primary receptacle of fluid-tight construction and a secondary containment and support vessel receiving and positioning a portion of the primary vessel, with the primary vessel having a generally conical top surface portion, a shoulder formed therein and an inlet opening in one of the shoulder surfaces, with the primary receptacle also having upper, lower, and preferably intermediate sidewall sections, with the upper and one of the lower sidewall sections being joined to each other by a circumferential shoulder overlying a portion of a support shoulder on the secondary vessel, and wherein the secondary vessel contains a plurality of contoured portions for registration with the tines of a forklift and wherein the primary receptacle contains a dual-access cover system.

The exact manner in which the foregoing and other objects and advantages of the invention are achieved in practice will become more clearly apparent when reference is made to the following detailed description of a preferred embodiment of the invention set forth by way of example and shown in the accompanying drawings, wherein like reference numbers indicate corresponding parts throughout.

DESCRIPTION OF THE PREFERRED EMBODIMENTS OF THE INVENTION

Figure 1:
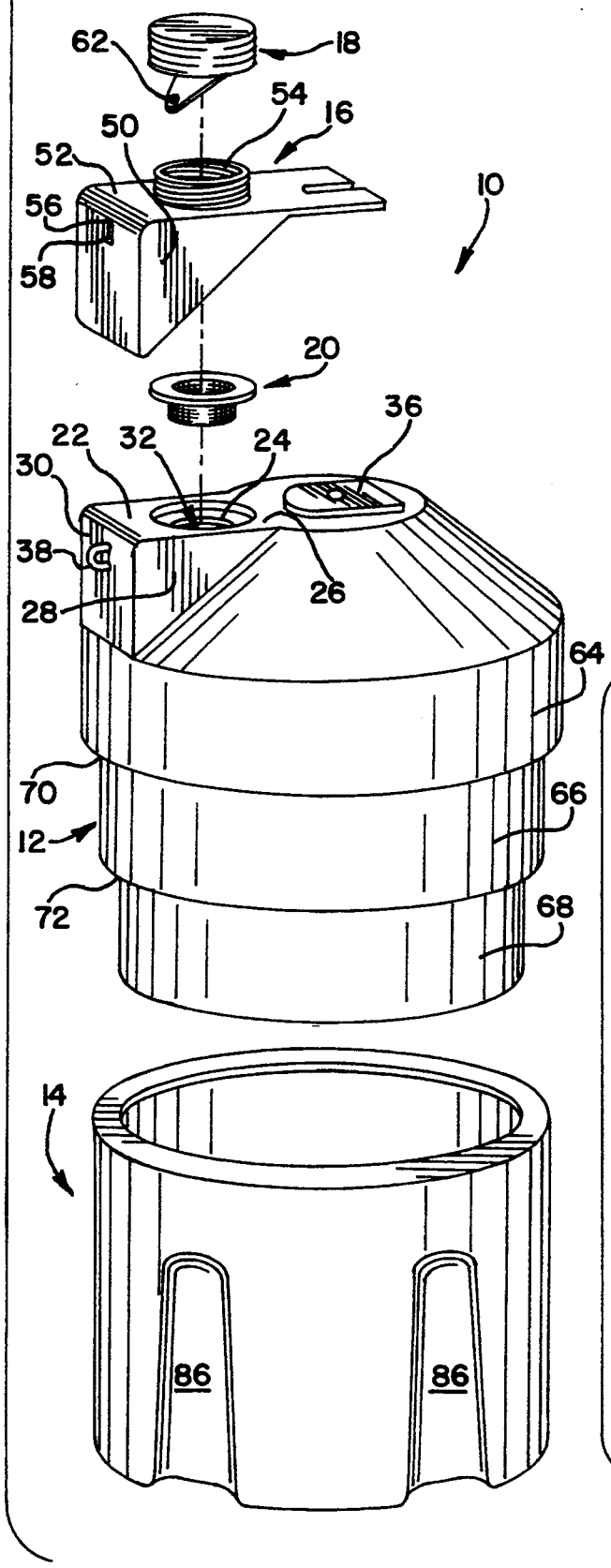
FIG. 1 is an exploded perspective view of the storage and transport container of the invention, showing the principal elements thereof.
Figure 2:
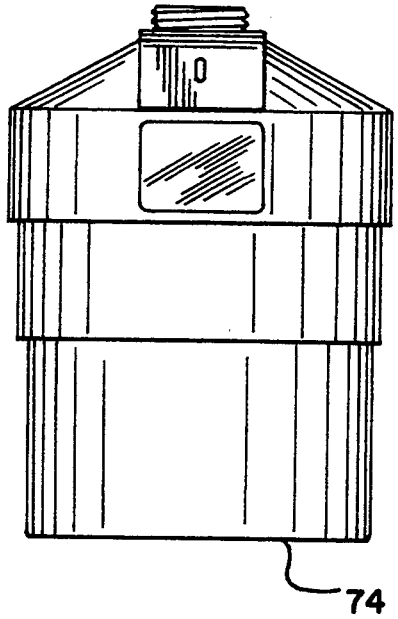
FIG. 2 is a front elevational view of the primary receptacle of FIG. 1.

While the present invention may be embodied in various forms that differ somewhat from each other in detail, a description of one preferred embodiment will be given wherein the materials are made substantially entirely from plastic materials and wherein other preferred features of construction are provided. In a typical embodiment, the unit is sized so as to be almost four feet high and to contain approximately 150 gallons of used coolant.

Referring now to the drawings in greater detail, a storage and transport container generally designated 10 and made according to the invention is shown. Some of the principal components include a primary, liquid-tight receptacle generally designated 12, a secondary containment and support receptacle generally designated 14, a shoulder cover and cap support unit generally designated 16, a cap unit generally designated 18, and a removable screen unit generally designated 20.

Referring now to the primary receptacle 12, this unit is shown to include a generally frusto-conical top surface portion 22, an inlet area shoulder generally designated 24 and shown to include a generally flat top wall portion 26, a pair of opposed shoulder sidewalls 28, a front face surface 30, an inlet opening generally designated 32, a guide boss 34 (FIG. 3) and a hold-down plate 36. The front face surface 30 of the shoulder 24 includes the eye portion 38 of a hasp to provide a security feature, as will appear. The hold-down plate 36 is held in place relative to the boss 34 by suitable rivets 40 or the like.

Figure 3:
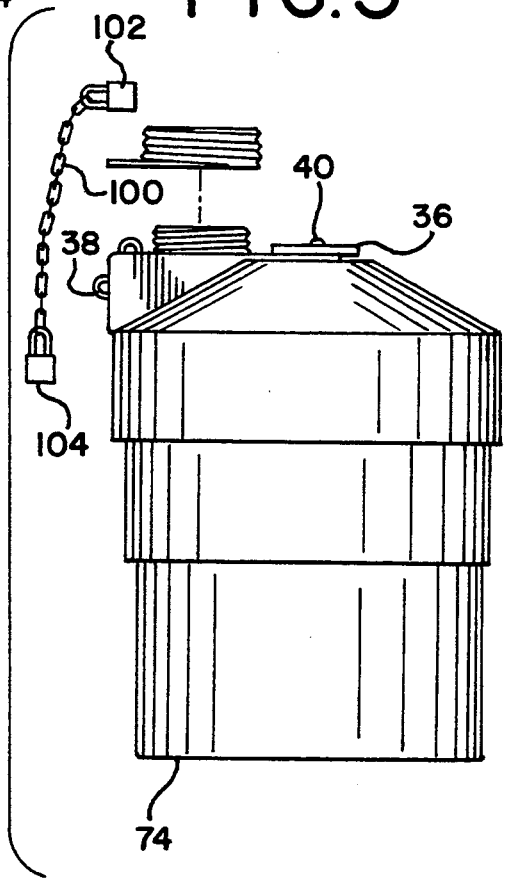
FIG. 3 is a side elevational view of the receptacle of FIG. 2.
Figure 4:
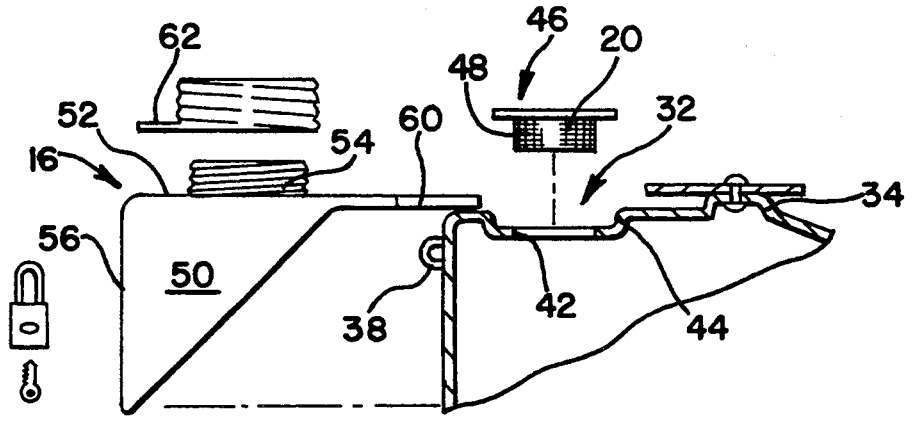
FIG. 4 is an enlarged fragmentary vertical sectional view, with portions broken away, showing a part of the upper container shoulder and inlet opening broken away, also showing the screen unit in exploded relation, and taken along lines 2—2 of FIG. 1.

As shown in FIGS. 3 and 4, the inlet opening 32 is defined by an inner edge 42 of a cylindrical countersink portion 44 lying beneath the top surface 26 of the shoulder 24. As also shown in FIGS. 3 and 4, margins defining the edge 42 serve to support a flange 46 extending outwardly from the sidewalls 48 of the filter screen basket 20. The sidewalls 48 of the filter screen basket 20 are sized such that the unit may be readily removed from the opening 32 as long as the cover and cap support 16 is removed.

Referring now to the shoulder cover and cap support unit 16, this element will be shown to include opposed sidewalls 50, a top wall portion 52, a threaded, cylindrical collar 54, a front wall or faceplate portion 56 having a slot 58 therein for accommodating an eye 38 on the front shoulder wall 24.

The opposite end portion of the shoulder cover and cap support unit 16 also includes an open ended, elongated slot 60 for sliding registration with the boss 34 (FIG. 4) to which the hold-down plate 36 is secured. In use, the threaded collar portion 54 of the cover and cap support unit 16 receives and positions the exterior cap 18. A tab 62 may be formed on one portion of the collar for cooperation with a chain and padlock arrangement used to secure the cap to the eye 38 and thus prevent rotation of the cap or other tampering.

Referring now to the remainder of the primary receptacle, it will be noted that, in the preferred form shown, the receptacle is defined by upper, intermediate, and lower, generally cylindrical sidewall sections respectively designated 64, 66, 68. An offset or shoulder 70 is provided where adjacent sidewalls 64, 66 are joined to each other, and another shoulder 72 is provided where the walls 66, 68 meet. A continuous, flat surface 74 forms the bottom of the receptacle.

Figure 5:
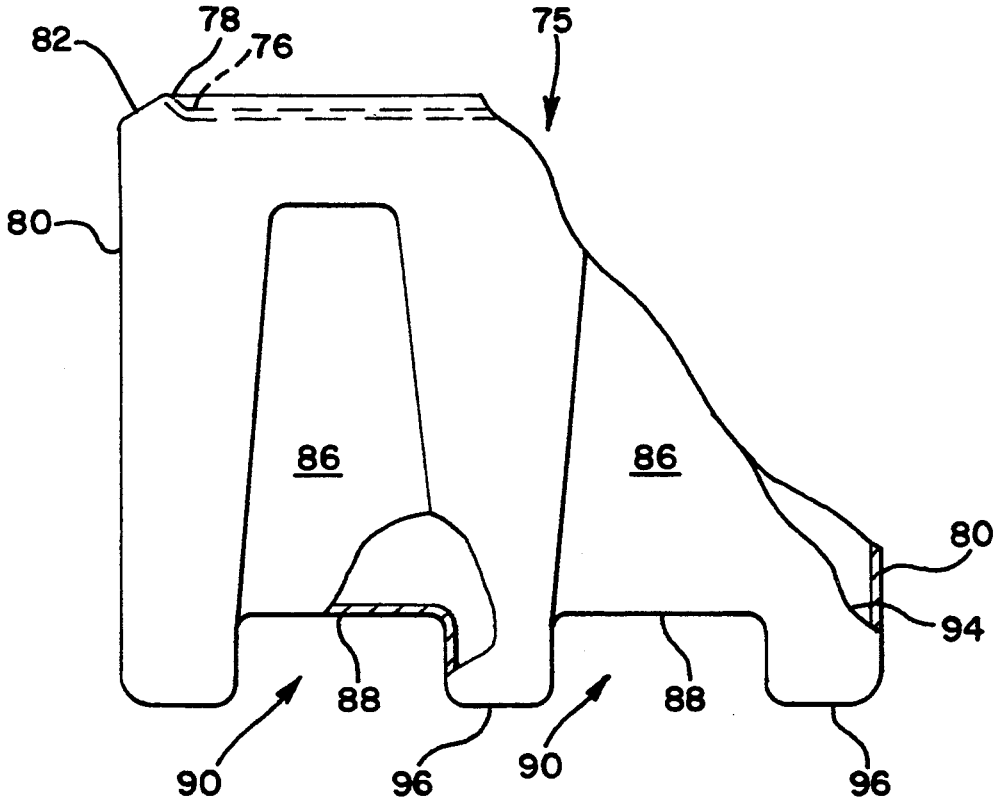
FIG. 5 is a fragmentary elevational view of the secondary containment and support vessel of FIG. 1.

Referring now to the secondary containment and support vessel generally designated 14, certain details of its construction is shown in FIG. 5. Here, it will be noted that the vessel 14 includes a top center opening generally designated 75 and defined by the inner edge 76 of a down-turned mounting shoulder margin 78. The exterior sidewall 80 of the outer vessel is cylindrical in part, but also contains contoured portions to which reference will. be made later. Referring to the cylindrical sidewall portion 80, which extends continuously around the uppermost portions of the vessel 14, it will be noted that a frustoconical outer margin 82 extends inwardly from and is joined to the upper portions of the cylindrical sidewall 80. Where the margin 82 is turned up on itself to extend radially inwardly and axially downwardly, the shoulder 78 is formed.

The support edge 84 formed by these surfaces is adapted in use to position the primary vessel 12 by engagement of the shoulder 70 between the upper and intermediate sidewall portions 64, 66 of the container. While it is not necessary that a physical support function be provided, it is desired that the lip 84 at least approach engagement with the shoulder 70, and the parts are sized, constructed and arranged so that the outside diameter of the cylindrical wall surface 64 is larger than that of the lip 84.

Likewise, the outside diameter of the intermediate surface 66 is equal to or preferably just smaller than the opening 75 defined by the diameter of edge 76 of the support and containment vessel. With this arrangement of diameters, rain or other fluid on the sidewall 64 will engage the tapered surface 82 and remain outside the secondary vessel. The parts are arranged, however, so that the two vessels may be readily separated, and thus an interference fit between them is not desired.

As shown in FIGS. 1 and 5, the sidewalls 80 of the vessel 14 may include, by way of example, four depressed panels 86, which the inner surfaces of which may engage or be spaced from the intermediate and lower sidewalls 66, 70 of the primary vessel 12. If these surfaces do not engage, the panels in any case provide increased bending stiffness to the container sidewalls. Preferably, as shown in the drawings, the depressed panels 86 are formed as continuations of lower, horizontal surfaces 88 which extend chordwise through the lower portion of the exterior vessel 14, thus defining slots generally designated 90 for engagement by the tines (not shown) of a forklift truck.

In addition, in the preferred form of apparatus, the inner, upwardly directed surface portions 92 of the walls 88 provide a rest or support surface for the bottom surface 74 (FIG. 3) of the primary receptacle 12. With this arrangement, the exterior vessel can readily support the interior or primary vessel in normal use, and when the occasion arises for lifting and transporting the container system, the forklift tines engage the inner receptacle through a "solid height" of material from which the exterior container is made. In other words, the interior container is lifted through the exterior container, but the side and bottom walls are not stressed in bending, and hence the exterior container 14 may be constructed in an advantageous manner.

Another feature resulting from the construction of the exterior or secondary vessel as shown in FIG. 5 is that, in effect, pockets 94 are defined beneath the slot-defining surfaces 88 and above the lowermost walls 96 of the secondary receptacle. These pockets can accommodate minor amounts of leakage which may occur in use of the primary receptacle.

Referring now to the use of the receptacle, assuming that it is assembled with the two receptacles in a nested relation, the cap and the cap support unit 16 are both locked in place. In the preferred form of use, separate locks are provided for the cap unit 18 and for the shoulder cover and cap support unit 16.

Assuming now that a vehicle has been serviced and its anti-freeze drained into a pan or the like, the operator unlocks the cap 18 with his own key provided by the recovery service. The operator then unscrews the cap 18 from the support unit 16. The anti-freeze is poured through the opening into the exterior of the primary receptacle, passing through the filter basket screen 20. Because the shoulder cover and cap support unit 16 remains secured by another lock against axial removal by the locking eye and slot arrangement 38, 58, removing the contents from the container is prevented. The screen blocks off the entry of hoses or dip tubes. The shoulder cover cannot be removed from the other end either, because the other end is secured beneath the hold-down plate 36. Thus, only a recovery service person can remove the cap and cover support unit.

After a single batch of anti-freeze is deposited in the container, the cap 18 is replaced. This cycle is completed until the container reaches its capacity, at which time a service call is indicated. At this point, the vessel, which contains about 150 gallons and thus weighs about 1950 pounds, is either drained on the premises by a recovery service employee or is taken as a unit to a recycling center for emptying. At this time, the shoulder cover and cap support unit 16 is removed radially and then taken from the inner receptacle.

The filter basket 20 is removed for inspection and the contents of the container are emptied through the opening 32. The large size of this opening permits ready cleaning of any sludge or the like which is accumulated by sedimentation in the bottom of the receptacle 12. The exterior container may be inspected for security and, as pointed out above, the entire receptacle system may be handled by a forklift. Thereupon, the unit is reassembled and returned to service.

While different materials may be used in the construction of the unit, it has been found most economical and advantageous to use low density polyethylene for the two receptacles, and nylon for the cap and collar.

In FIG. 3, a chain 100 and a pair of padlocks 102, 104 are shown. While these locks and the hasps, eyes, etc. with which they cooperate in use are not crucial to the invention. They are illustrated merely to show the potential for separating the locking or security functions between the on-site, user-accessible lock 102 and the recovery system operator lock 104. An important feature of the invention, is that there be separate security systems, one permitting additions to the container, and the other permitting removal of the contents from the container. In this way, even if the on-site user negligently leaves the removable cap unlocked, the screen is locked in place and prevents contents removal.

It will thus be seen that the present invention provides an improved anti-freeze storage and transport container having a number of novel advantages and characteristics, including those heretofore pointed out and others which are inherent in the invention. A preferred embodiment of the invention having been described by way of example, it is anticipated that the variations in the described form of construction may occur to those skilled in the art, and that such variations may be made without departing from the spirit of the invention or the scope of the appended claims.

We claim:

1. A serviceable storage and transport container, for used anti-freeze solutions, said container comprising, in combination, a fluid-tight primary receptacle and a secondary containment and support vessel for said primary receptacle, said fluid-tight primary receptacle having a generally conical top surface portion, a shoulder formed in said top surface portion, said shoulder being defined at least in part by a shoulder top wall extending outwardly from the center of said conical top surface portion, and a pair of shoulder sidewalls extending between and joining said conical top surface portion to said shoulder top wall, and a front shoulder wall joined to said shoulder top wall and said shoulder sidewalls, with a contents access opening being formed in said shoulder top wall, said primary receptacle also including at least upper and lower sidewall sections of circular cross-section, and a compound closure system for said primary receptacle, said closure system including a contoured shoulder cover and cap support unit having walls overlying and closely spaced from said shoulder top wall and said shoulder sidewalls, said shoulder cover including a cap-receiving collar portion with a collar access opening therein, said collar access opening being registrable with said access opening when said shoulder cover is in the closed position, a cap received over said collar access opening on said shoulder cover, with said container also including cooperating means on said shoulder cover and said container for preventing removal of said cap relative to said collar portion and of said shoulder cover from said shoulder, said secondary containment and support vessel including a bottom wall and a continuous outer sidewall section, a support shoulder joined to an upper margin of said outer sidewall section and extending at least partially upwardly and inwardly therefrom to define a center opening in said secondary vessel for receiving said primary receptacle, said containment vessel further including wall panel surfaces forming portions of said bottom wall and being contoured so as to register with fork lift tines on their outer surfaces and to engage a bottom surface of said primary receptacle on their inner surfaces.

* * * * *